US005463944A

United States Patent [19]

Wolf et al.

[11] Patent Number: 5,463,944

[45] Date of Patent: Nov. 7, 1995

[54] ROTATABLE BALE RELEASE MECHANISM FOR A BALER MACHINE AND METHOD OF BALING

[75] Inventors: Robert J. Wolf, Waukesha; Leroy J. W. Schuman, Wauwatosa, both of Wis.

[73] Assignee: Logemann Brothers Co., Milwaukee, Wis.

[21] Appl. No.: 323,971

[22] Filed: Oct. 17, 1994

[51] Int. Cl.[6] ..... B30B 13/00; B30B 15/32

[52] U.S. Cl. ..... 100/35; 100/218; 100/232; 100/250; 100/255

[58] Field of Search ..... 100/35, 218, 232, 100/242, 246, 249, 250, 253, 255

[56] References Cited

U.S. PATENT DOCUMENTS

| | | | |
|---|---|---|---|
| 798,679 | 9/1905 | Hulscher | 100/250 |
| 3,514,969 | 6/1970 | Harza | 100/218 |
| 4,420,296 | 12/1983 | Anderson | 100/250 |
| 4,658,719 | 4/1987 | Jackson et al. | 100/232 |
| 5,007,337 | 4/1991 | Newsom | 100/253 |
| 5,081,922 | 1/1992 | Rudd, Jr. et al. | 100/253 |
| 5,201,266 | 4/1993 | Schmalz et al. | 100/232 |
| 5,353,698 | 10/1994 | Robbins | 100/255 |

FOREIGN PATENT DOCUMENTS

| | | | |
|---|---|---|---|
| 477083 | 3/1976 | U.S.S.R. | 100/218 |
| 1003139 | 9/1965 | United Kingdom | 100/218 |

*Primary Examiner*—Stephen F. Gerrity
*Attorney, Agent, or Firm*—Paul R. Puerner

[57] ABSTRACT

A baler machine including a charging chamber for receiving materials to be baled. The charging chamber has a charging passageway communicating with a baling compression chamber. A compression ram is operable to force material from the charging chamber into the compression chamber to thereby form a bale. The compression chamber has an exit passageway through which the baled material is forced by an ejector ram. A bale release mechanism is mounted adjacent the exit passageway. The bale release mechanism includes a rotatably mounted gate member movable between a normal operating position and a retracted open position wherein the size of the exit passageway is increased to allow the passage of an oversized bale. A power cylinder is operatively connected to the bale release mechanism to move the mechanism between its closed and retracted positions.

7 Claims, 4 Drawing Sheets

10
12
14
16
18
20
22
30
32
34
38
40
41
42
43
44
46
48
50
52
54
56
58
60
62
64

ROTATABLE BALE RELEASE MECHANISM FOR A BALER MACHINE AND METHOD OF BALING

BACKGROUND OF THE INVENTION

In a conventional baler machine which is not equipped with the improvement of this invention, the compression ram head will on occasion move too much material into the compression chamber where the bale is formed so that the material protrudes back from the compression chamber into the charging passage which leads from the charging chamber to the compression chamber. Such a situation may occur, for example, if an excessive amount of material is originally charged into the bale charging chamber. Under such a condition, the compression ram head cannot be advanced to its normal baling eject position, i.e., with the base of the compression ram head in alignment with the side wall of the discharge passage from the compression chamber through which the bale is ejected. Under such circumstances, the width of the bale will be greater than that of the discharge passage and thus the oversized bale cannot be ejected through the discharge passage by the ejector ram head. In a conventional baler, such an oversized bale condition can be remedied only by a manual removal of the excess material in the baling chamber to thereby reduce the size of the oversized bale. Such a manual removal operation is time-consuming.

One attempt to deal with this problem is a baler mechanism described in U.S. Pat. No. 5,201,266. This mechanism is effective from an operational standpoint, but is relatively complex and costly.

As will be explained more fully in the description which follows, the bale releasing mechanism of the present invention contemplates a design wherein the exit passageway size can be increased to accommodate oversized bales of various size. The mechanism is relatively simple and less costly than prior mechanisms. Other advantages will be apparent from the description which follows.

SUMMARY OF THE INVENTION

A baler machine comprising a charging chamber for receiving material to be baled, said charging chamber having a charging passageway through which material is forced into a baling compression chamber by a compression ram. An ejector ram is provided for forcing compressed material in bale form out of the baling compression chamber through an exit passageway. A rotatable bale release mechanism is provided which, upon actuation, will increase the effective size of the exit passageway from the compression chamber. A power means is provided to pivot the release mechanism from a normal operating position to a second position wherein the effective size of the exit passageway is increased to permit the ejection of an oversized bale from the compression chamber should such a condition be encountered.

DETAILED DESCRIPTION OF THE INVENTION

Figures 1, 2:
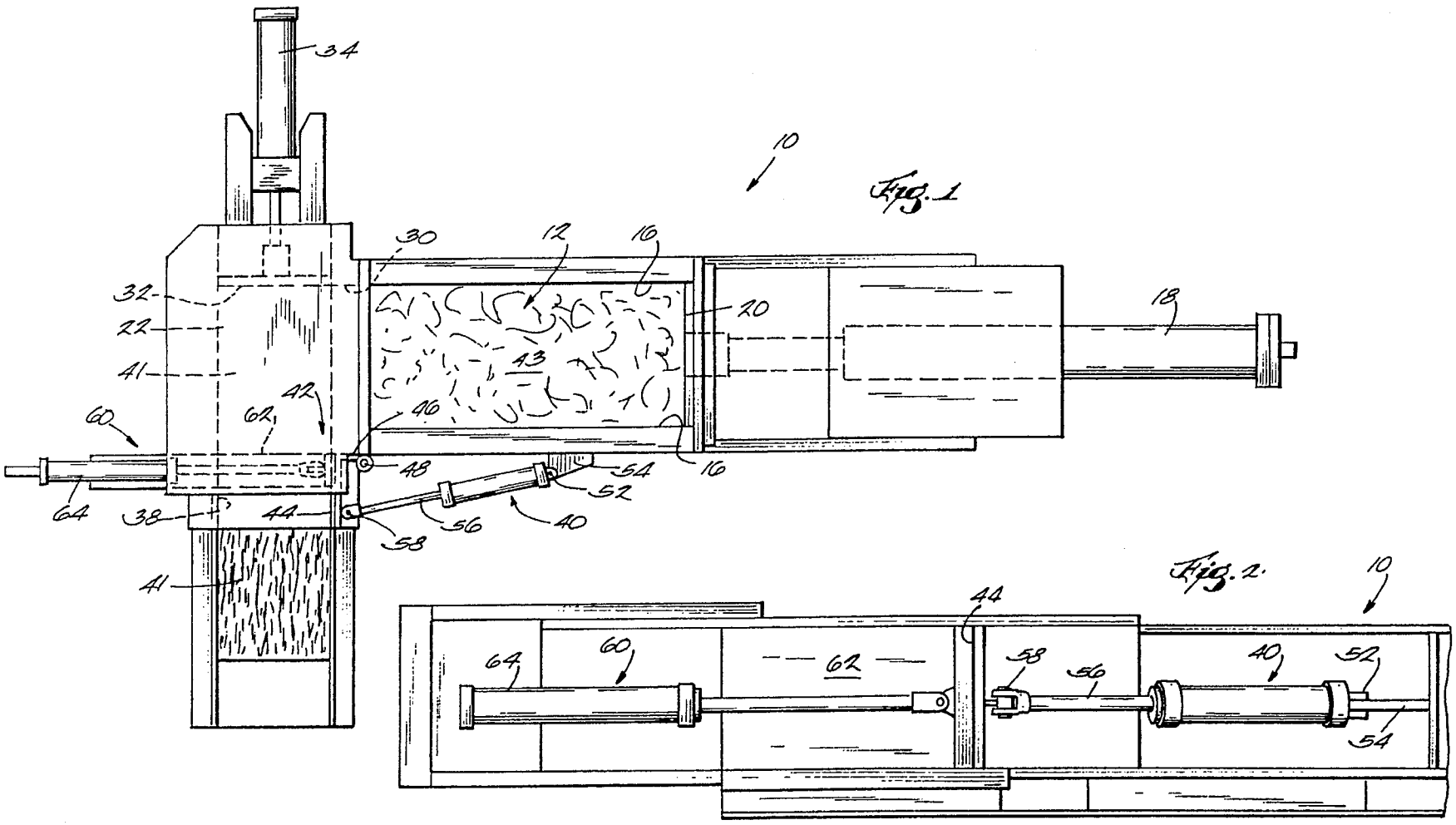
FIG. 1 is a partially schematic plan view of the baler machine of this invention.
FIG. 2 is a partial side elevation view of the baler machine shown in FIG. 1.

Referring to the drawings, baler machine 10 is designed for baling waste material such as paper, cardboard, corrugated containers, used beverage cases, municipal solid waste, etc. Machine 10 has a charging chamber 12 into which waste material is loaded. The charging chamber 12 is generally rectangular in horizontal section having a flat floor and opposed side walls 16. The baler machine 10 includes a hydraulic compression cylinder 18 having a compression ram head 20 which is movable horizontally in the charging chamber 12.

The charging chamber 12 communicates with a compression chamber 22 through a charging passage 30. The waste material is compressed from the charging chamber 12 into the compression chamber 22 by the forward movement of compression ram head 20.

The baler machine 10 further includes a bale ejection cylinder 34 having an ejection ram head 32. The compression chamber 22 is provided with a exit passageway 38.

A bale release mechanism 40 is mounted at one side of the exit passageway 38. The mechanism is comprised of a rotatably mounted gate member 42 comprised of a face member 44 and an arm member 46. The arm member 46 is pivotally mounted at a pivot means 48 of any suitable design.

Gate member 42 is rotated between a closed position (FIGS. 3, 4, 7) and an open position (FIGS. 5, 6) by a hydraulic cylinder 50. Cylinder 50 is pivotally connected at one end 52 to a stationary support 54. The power actuator rod 56 of the cylinder 40 is pivotally connected to the exterior surface of the face member 40 as indicated by reference numeral 58. In a typical baler construction of the type shown herein, a bale strapping apparatus of suitable design (not shown) is mounted in the area into which the bales are ejected by ejector head 32.

An exit gate mechanism 60 is mounted in the exit passageway 38. The mechanism is comprised of a slidable gate member 62 which is movable between an open position (FIGS. 5, 6) and a closed position (FIGS. 3, 4, 7) by a hydraulic exit gate cylinder 64.

OPERATION

To describe the operation, reference is made to FIGS. 3, 4, 5, 6 and 7. After the charging chamber 12 has been filled with waste material 43, the charging ram head 20 is advanced to push waste material through the charging passage 30 and into the compression chamber 22.

Figure 3:
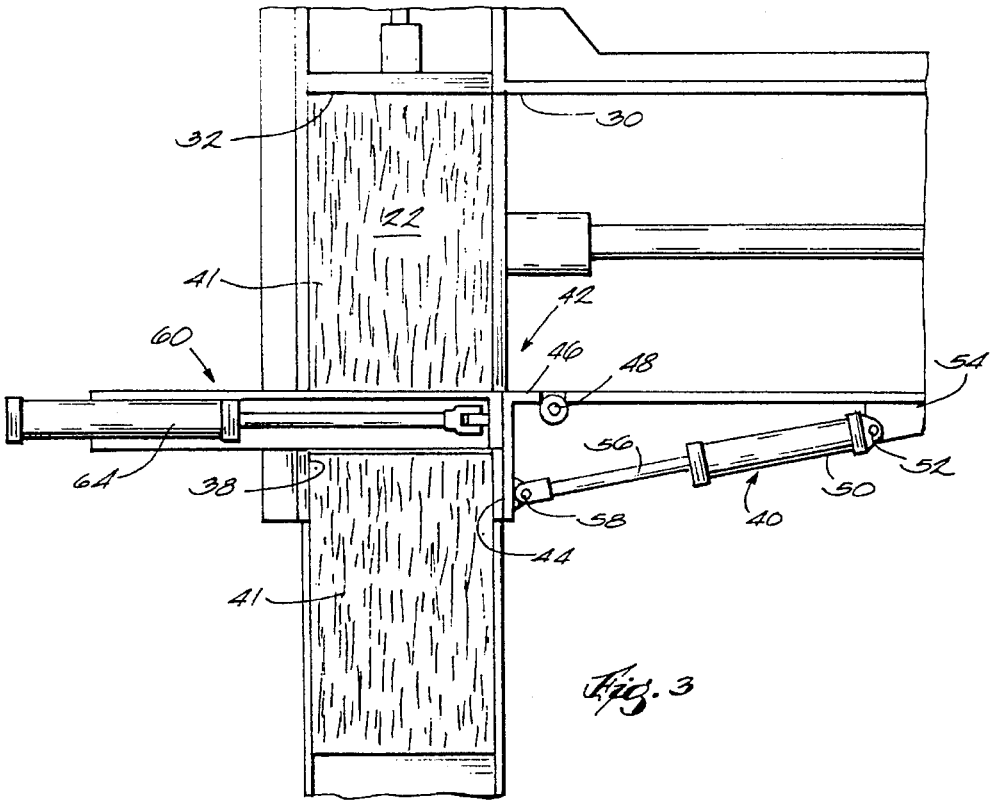
FIGS. 3, 4, 5, 6 and 7 are partially schematic plan views showing the bale release mechanism in its various operational positions.

In normal operation, after the chamber 22 has been filled with waste material and compressed to a suitable density, the charging ram head 20 stops in advanced position substantially flush with the corresponding side or edge of the ejection ram head 32 as shown in FIG. 3 to thereby produce a standard sized bale 41. After gate 62 is moved to the open position, the ejection ram head 32 is then advanced step-by-step to push the material out of the baling chamber 22 through the exit passage 38. The compressed material in its bale shape is tied by a strapping mechanism of conventional design (not shown). At each pause between incremental advances of the ram 32, the ejected material is tied with an encircling strap or wire by the strapping mechanism located just outside the exit passage 38.

After the standard sized bale is ejected completely from the chamber 22, the gate 62 is moved from its open to its closed position by energization of cylinder 64. Compression of material in chamber 22 and ejection therefrom is thus repeated to form subsequent standard sized bales.

Figure 4:
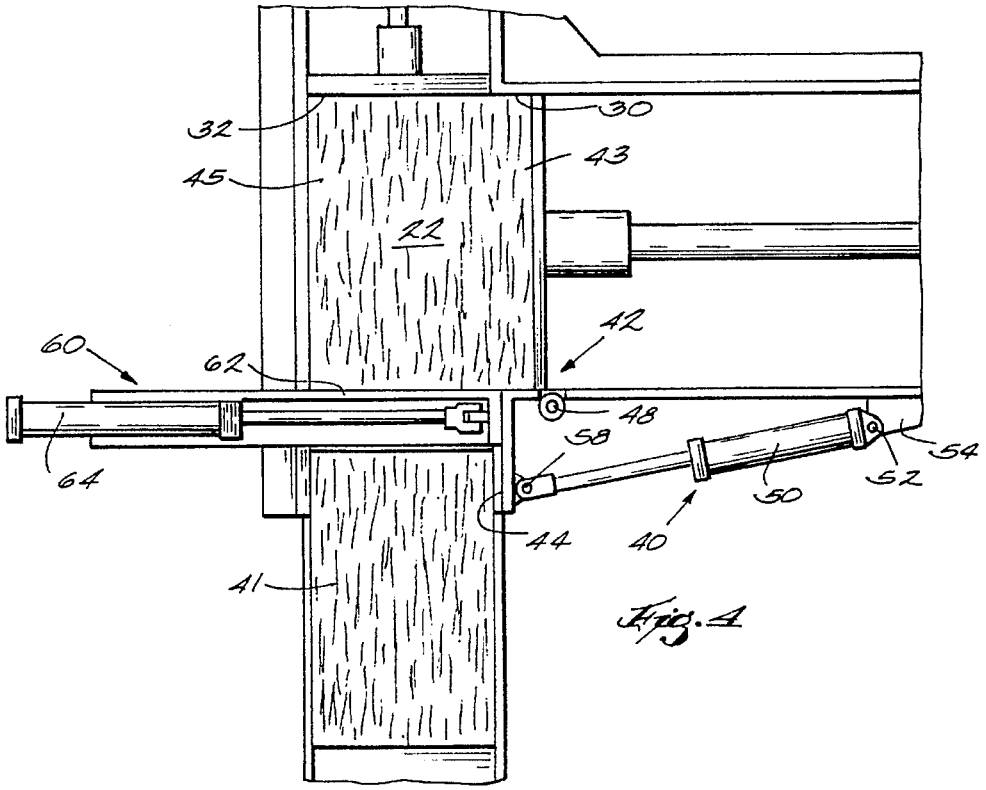

The problem to which this invention is directed is a situation where an excess of waste material is charged into the baling chamber 22. When this occurs, the compression ram head 20 is unable to push the last charge of material completely out of the charging passage 30 into the baling compression chamber 22. The condition is shown in FIG. 4, wherein a portion 43 of the charge in the chamber 22 protrudes back into the charging passage 30, resulting in an over sized bale 45. It is difficult, if not impossible, to eject the over-sized bale 45 out of the chamber 22 through the exit passage 38 by the operation of the ejection ram head 32. A time-consuming manual clearing of the excess material would be required absent the operation of the present invention.

Figure 5:
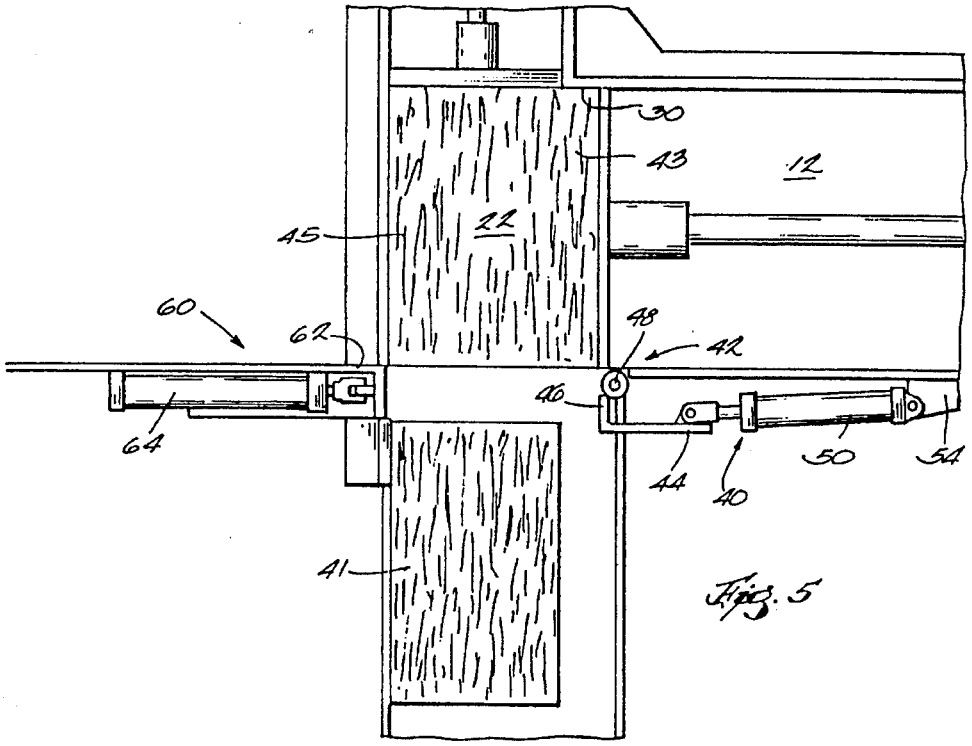
Figure 6:
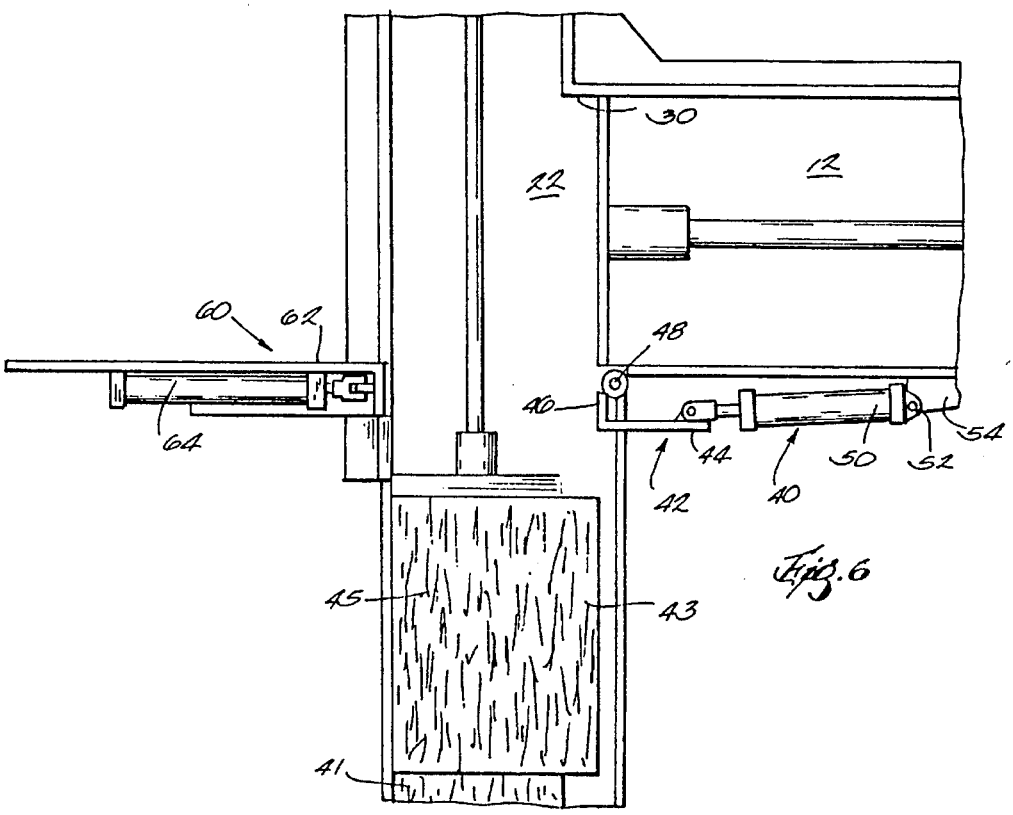

This problem is very effectively solved by the operation of the bale release mechanism 40 shown in FIGS. 4, 5, 6 and 7. Referring to FIGS. 4 and 5, gate member 42 is retracted by cylinder 50 from the position shown in FIG. 4 to the position shown in FIG. 5. Slidable exit gate member 62 is moved from its closed position (FIG. 4) to its open position (FIG. 5) by exit gate cylinder 64.

With the release mechanism 40 in the FIG. 5 position and the exit gate 62 open, the enlarged bale 45 can now be ejected from the compression chamber 22 by ejector ram head 32. With the bale release mechanism 40 retracted, the discharge passageway from the compression chamber 22 is in effect enlarged by the length of arm 46 of the gate member 42. Thus, as indicated, such retracted movement of release mechanism 40 effectively facilitates ejection of the enlarged bale 45 from the baling chamber 22 through the exit passageway 38 to the position shown in FIG. 6.

Figure 7:
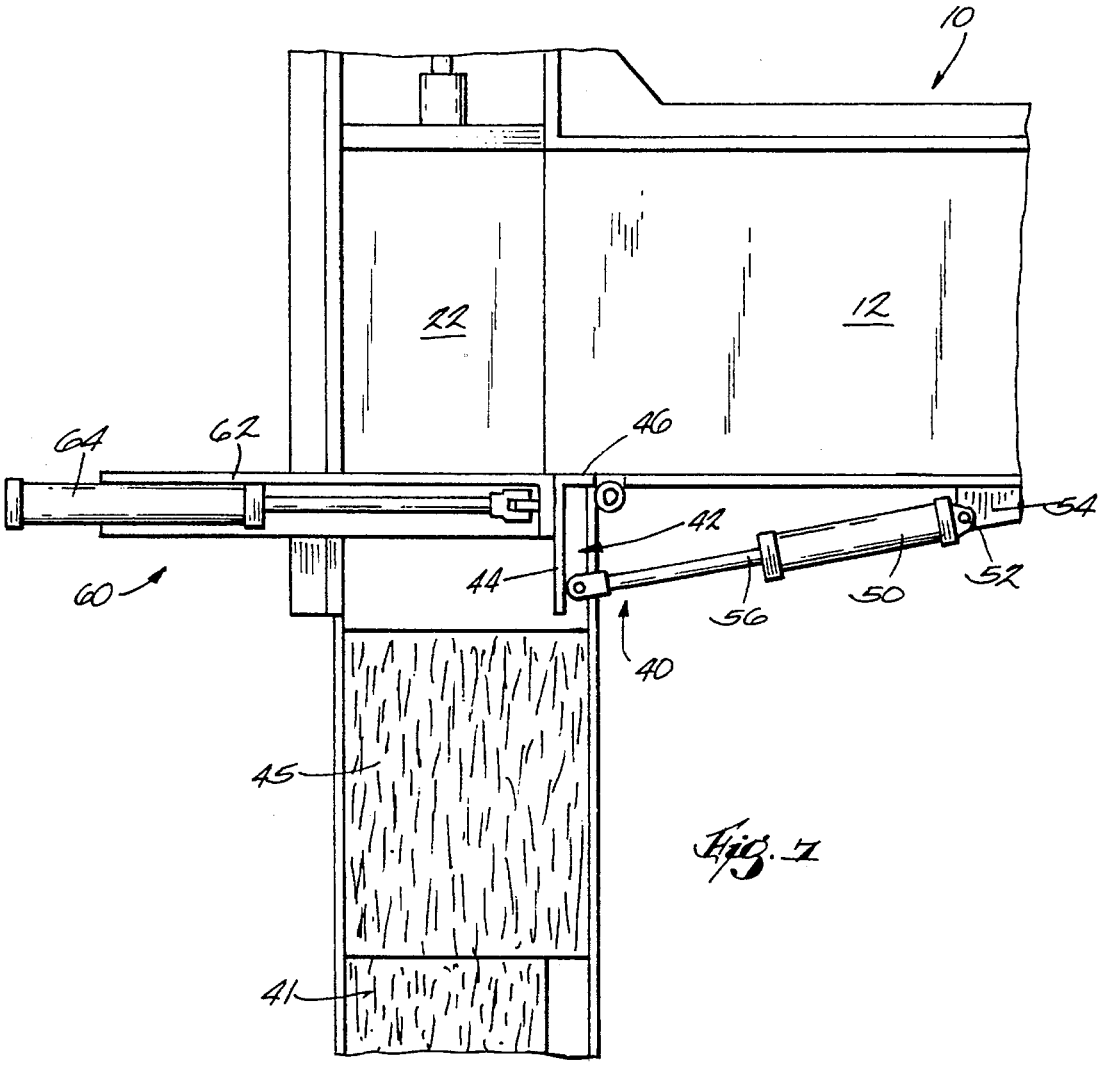

Bale release mechanism 40 is then actuated back to its closed position and gate mechanism 60 is also actuated to its closed position as shown in FIG. 7. The bale forming operation can then continue.

While the subject invention has been shown and described in what is presently conceived to be the preferred embodiment, it will be obvious to one of ordinary skill in the art that modifications may be made thereof within the scope of the invention, which scope is not to be limited except by the appended claims.

We claim:

1. A baler machine comprising:

(a) a charging chamber means (12) for receiving material to be baled, said charging chamber means having a charging passageway means (30);

(b) a baling compression chamber means (22) communicating with said charging chamber means through said charging passageway means, said baling compression chamber means having an exit passageway means (38);

(c) a compression ram means (18, 20) operable to force material from said charging chamber means into said baling compression chamber means through said charging passageway means to thereby compress material in said baling compression chamber means;

(d) ejector ram means (32, 34) for forcing compressed material out of said baling compression chamber means through said exit passageway means;

(e) a bale release mechanism means (40) mounted adjacent said exit passageway means, said bale release mechanism means including a rotatably mounted gate member (42) movable between a normal operating closed position wherein the size of the exit passageway means will allow passage of a standard sized bale and a retracted open position wherein the-size of the exit passageway means is increased to allow passage of an over sized bale;

(f) power means (40) operatively connected to said bale release mechanism means to move said bale release mechanism between its closed and retracted positions.

2. A baler machine according to claim 1 in which said rotatably mounted gate member (42) is comprised of a face member (44) and an arm member (46), said arm member being pivotally mounted at one end thereof.

3. A baler mechanism according to claim 1 in which there is an exit gate member (62) mounted at said exit passageway means (38), said exit gate member being movable between a closed position and an open position wherein the exit passageway means is blocked when the gate member is in closed position and the exit passageway is open when the gate member is in its open position.

4. A baler machine including a charging chamber (12) for receiving material to be baled, a compression chamber (22) communicating with the charging chamber through a charging passageway (30), a compression ram (18, 20) operable to force material from the charging chamber into the compression chamber, an ejector ram (32, 34) for forcing compressed material out of the compression chamber through an exit passageway (38), the improvement comprising:

(a) a rotatably mounted gate member (42) mounted adjacent said exit passageway, said gate member rotatable between a normal operating closed position to a retracted open position, said gate member when in its retracted open position will effectively increase the size of said exit passageway;

(b) a power means (50) operatively connected to said rotatable mounted gate member and operable to move said gate member between its normal operating closed position and its retracted open position.

5. A baler mechanism according to claim 4 in which rotatably mounted gate member (42) is comprised of a face member (44) and an arm member (46), said arm member fastened at one end to said face member and rotatably mounted at the other end thereof.

6. A method of forming bales comprising the steps of:

(a) loading material into a charging chamber;

(b) forcing the material in the charging chamber into a bale compression chamber to form a bale therein, said bale compression chamber having an exit passageway through which bales are ejected;

(c) a rotatably mounted gate member mounted adjacent said exit passageway, said gate member movable between a normal operating closed position and a retracted open position, moving said gate member from its closed position to its open position to thereby increase the size of the exit passageway to facilitate the ejection of an oversized bale from the charging chamber; and (d) ejecting the oversized bale through the exit passageway of said baling compression chamber.

7. A method of forming bales according to claim 6 in which there is a gate member movably mounted at the compression chamber exit passageway, said gate member being movable between a closed position and an open position, said gate member adapted to be moved from its closed position to its open position to permit ejection of a bale from the compression chamber.

* * * * *